US006554648B2

(12) United States Patent
Shi et al.

(10) Patent No.: US 6,554,648 B2
(45) Date of Patent: Apr. 29, 2003

(54) UNIVERSAL SERIAL BUS RECEPTACLE CONNECTOR

(75) Inventors: GuangXing Shi, Kunsan (CN); Guo Zeng Zhang, Kunsan (CN); Ziqiang Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/909,728

(22) Filed: Jul. 19, 2001

(65) Prior Publication Data

US 2001/0053630 A1 Dec. 20, 2001

(51) Int. Cl.[7] ..... H01R 13/648
(52) U.S. Cl. ..... 439/607; 439/79
(58) Field of Search ..... 439/607–610, 439/79, 357, 358

(56) References Cited

U.S. PATENT DOCUMENTS 5,470,238 A * 11/1995 Walden ..... 439/607
5,975,954 A * 11/1999 Wu et al. ..... 439/607
6,059,581 A * 5/2000 Wu ..... 439/79
6,109,967 A * 8/2000 Chiou ..... 439/607
6,186,830 B1 * 2/2001 Lin et al. ..... 439/607

* cited by examiner

*Primary Examiner*—Hien Vu
(74) *Attorney, Agent, or Firm*—Wei Te Chung

(57) ABSTRACT

A USB receptacle connector (1) comprises an insulative housing (10), a plurality of terminals (14) received in the insulative housing and a shell (11) covering the insulative housing. The frond end of the shell forms a mating port (111) for insertion of a mating plug connector (1'). Either of two sidewalls (112) of the mating port defines a contact tab (115) which makes the shell of the USB receptacle connector always contact with a shell (11') of the mating plug connector. Thus, the two shells are continuously grounded so as to ensure reliable grounding and EMI shielding.

1 Claim, 6 Drawing Sheets

UNIVERSAL SERIAL BUS RECEPTACLE CONNECTOR

BACKGROUND OF THE INVENTION

1. Field of the Invention

The present invention relates to a universal serial bus (USB) receptacle connector, and particularly to a USB receptacle connector which can ensure reliable grounding and electromagnetic interference (EMI) shielding.

2. Description of Related Art

USB electrical connectors have been recently developed to replace a variety of computer input/output connectors for connection with various peripheral devices, for example, a mouse, keyboard, printer and scanner. Referring to FIG. 4 and FIG. 5, a conventional USB receptacle connector 7 which can connect with a conventional mating plug connector 7' comprises an insulative housing 70, a plurality of terminals 72 received in the insulative housing 70, a front shell 74 covering the front of the insulative, housing 70 and a rear shell 75 covering the rear of the insulative housing 70. The front shell 74 comprises a mating opening 740. Either of two opposite sides 743 of the mating opening 740 defines a pair of latches 741 extending from a mid-rear end of the front shell 74 to the mating opening 740. The latch 741 defines an engaging head 742 bent toward the insulative housing 70. When the USB receptacle connector 7 connects with the mating plug connector 7', the engaging heads 742 slide into rectangular holes 72' of an outer face 71' of a shell 74' of the mating plug connector 7' and are received in the rectangular holes 72'. After the front shell 74 of the USB receptacle connector 7 connects with the shell 74' of the mating plug connector 7', the two shells 74 and 74' can be grounded so as to ensure EMI shielding.

However, during the mating/unmating of the two connectors 7 and 7', the front shell 74 of the connector 7 is often enlarged and the engaging heads 742 of the latch 741 of the front shell 74 do not always contact with the outer face 71' of the shell 74' and therefore may have interval interruption. Referring to FIG. 6, the engaging heads 742 of the latch 741 of the front shell 74 are received in the rectangular holes 72' but do not contact with the shell 74'. Thus, the connection of the two shells 74 and 74' is not reliable.

SUMMARY OF THE INVENTION

Accordingly, the object of the present invention is to provide a USB receptacle connector wherein its shell defines a pair of contact tabs so as to make the shell of the USB receptacle connector continuously connect with the shell of the mating plug connector and ensure the USB receptacle connector havefavorable effect of EMI shielding all the time.

In order to achieve the object set forth, a USB receptacle connector comprises an insulative housing, a front shell part covering the front of the insulative housing, a rear shell part covering the rear of the insulative housing and a plurality of terminals received in the insulative housing. The front shell part forms a mating port for insertion of a mating plug connector. Either of two sidewalls of the mating port defines a pair of latches extending forward to the mating port. The latch defines an engaging head bent toward the insulative housing. Either of two sidewalls of the front shell part defines a contact tab extending from the mating port rearward and between the two latches. The two contact tabs respectively define a contact portion bent toward the insulative housing.

Other objects, advantages and novel features of the invention will become more apparent from the following detailed description when taken in conjunction with the accompanying drawings.

DETAILED DESCRIPTION OF THE INVENTION

Figure 1:
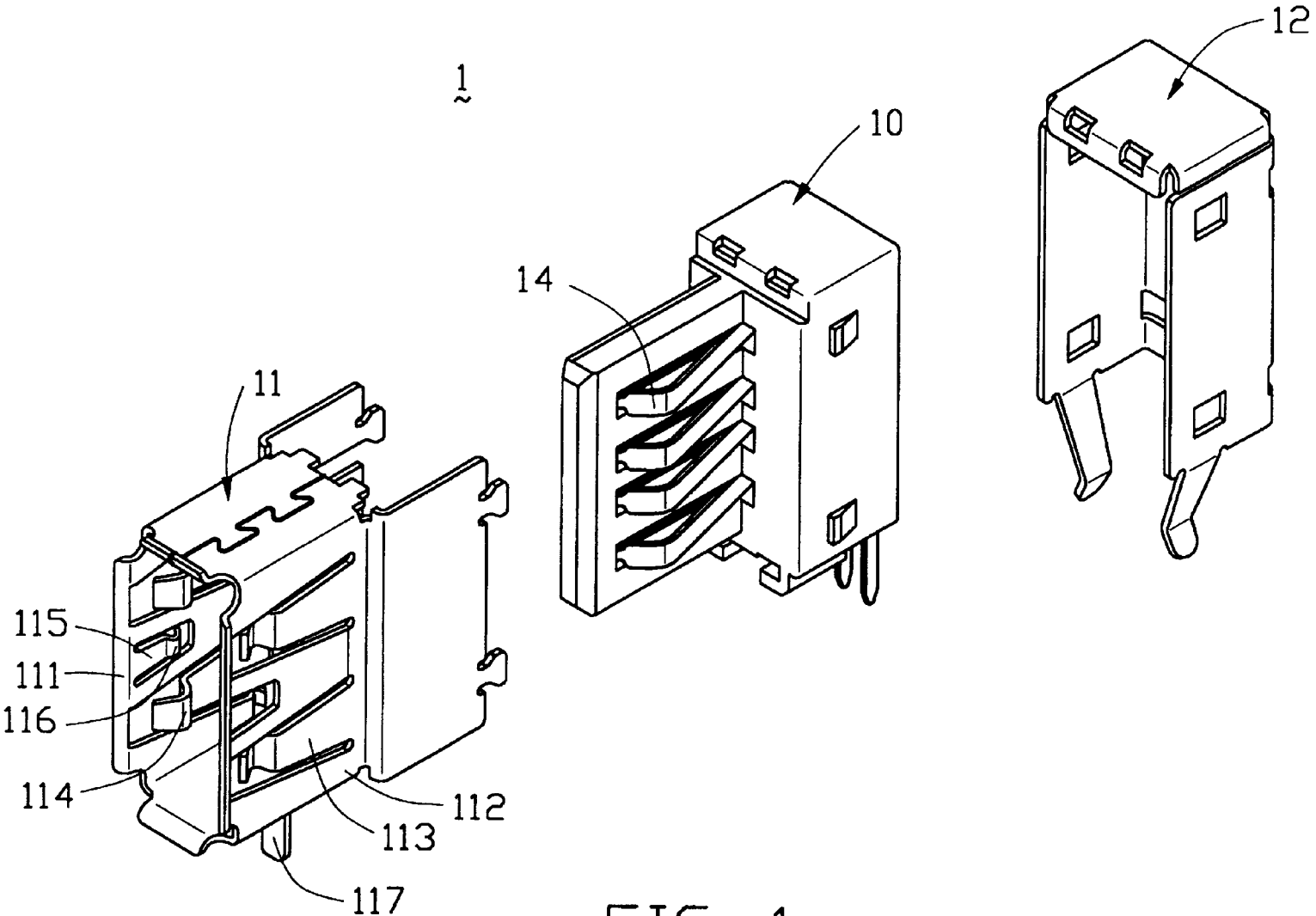
FIG. 1 is an exploded perspective view of a USB receptacle connector in accordance with the present invention.

Referring to FIG. 1, a USB receptacle connector 1 of the present invention comprises an insulative housing 10,a front shell part 11 covering the front of the insulative housing 10, a rear shell part 12 covering the rear of the insulative housing 10 and a plurality of terminals 14 received in the insulative housing 10.

The front shell part 11 defines a front end. The front end of the front shell part 11 forms a mating port 111 for insertion of a mating plug connector 1'. Either of two sidewalls 112 of the mating port 111 define a pair of latches 113 extending forward. Each latch defines a head. The head of the latch 113 defines an engaging head 114 bent toward the insulative housing 10. Either of the two sidewalls 112 of the front shell part 11 defines a contact tab 115 extending from the mating port 111 rearward and between the two latches 113. The two contact tabs 115 respectively define a contact portion 116 bent toward the insulative housing 10. In addition, a bottom face of the front shell part 11 defines a board lock 117 (referring to FIG. 3) for mounting the USB receptacle connector 1 onto a printed circuit board (PCB) (not shown).

Figure 2:
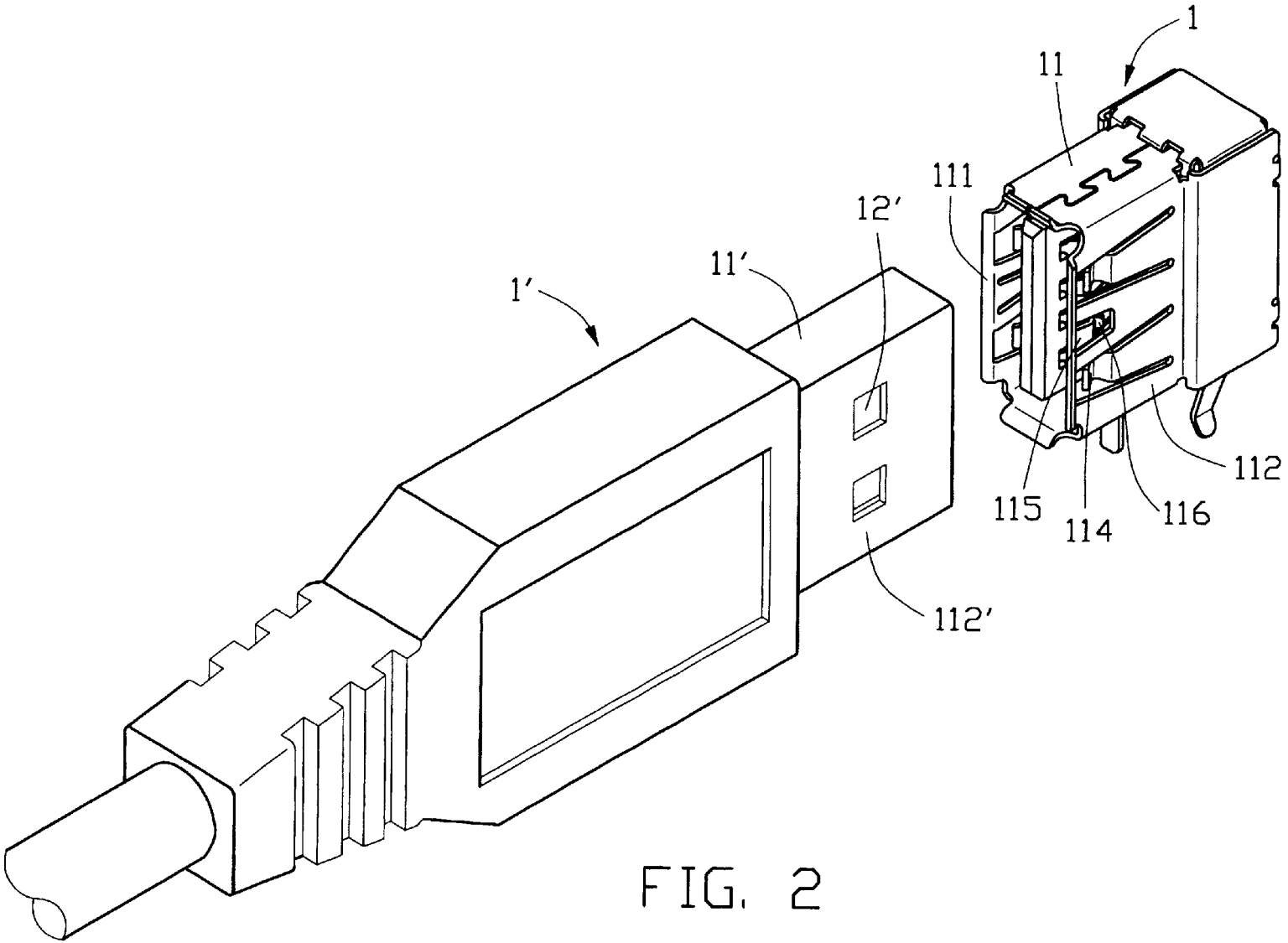
FIG. 2 is a perspective view of the USB receptacle connector in accordance with the present invention which has not connected with a mating plug connector.
Figure 3:
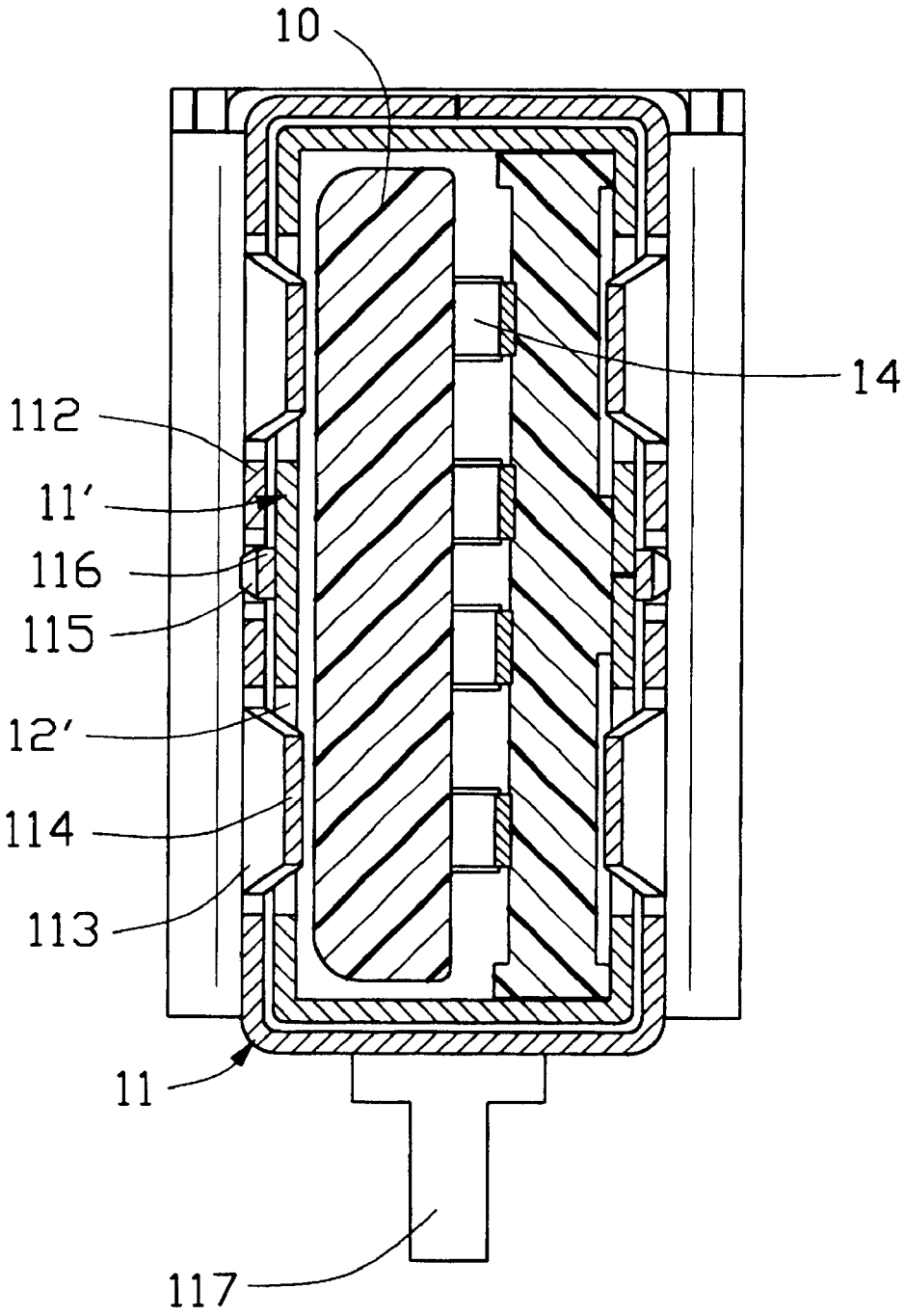
FIG. 3 is a sectional view of the USB receptacle connector in accordance with the present invention which has connected with the mating plug connector.
Figure 4:
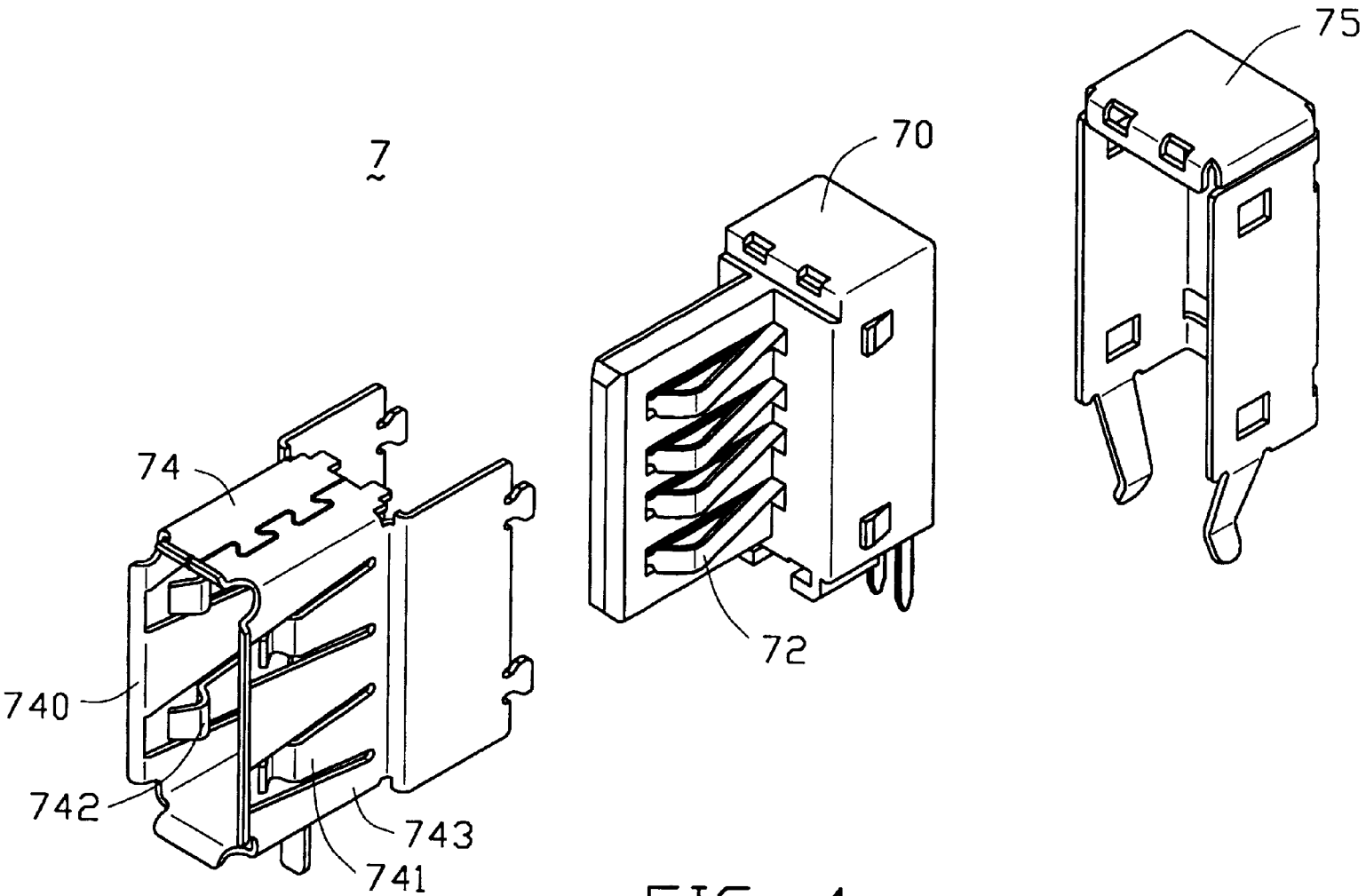
FIG. 4 (PRIOR ART)
FIG. 4 is a perspective view of a conventional USB receptacle connector which has not connected with a conventional mating plug connector.
Figure 5:
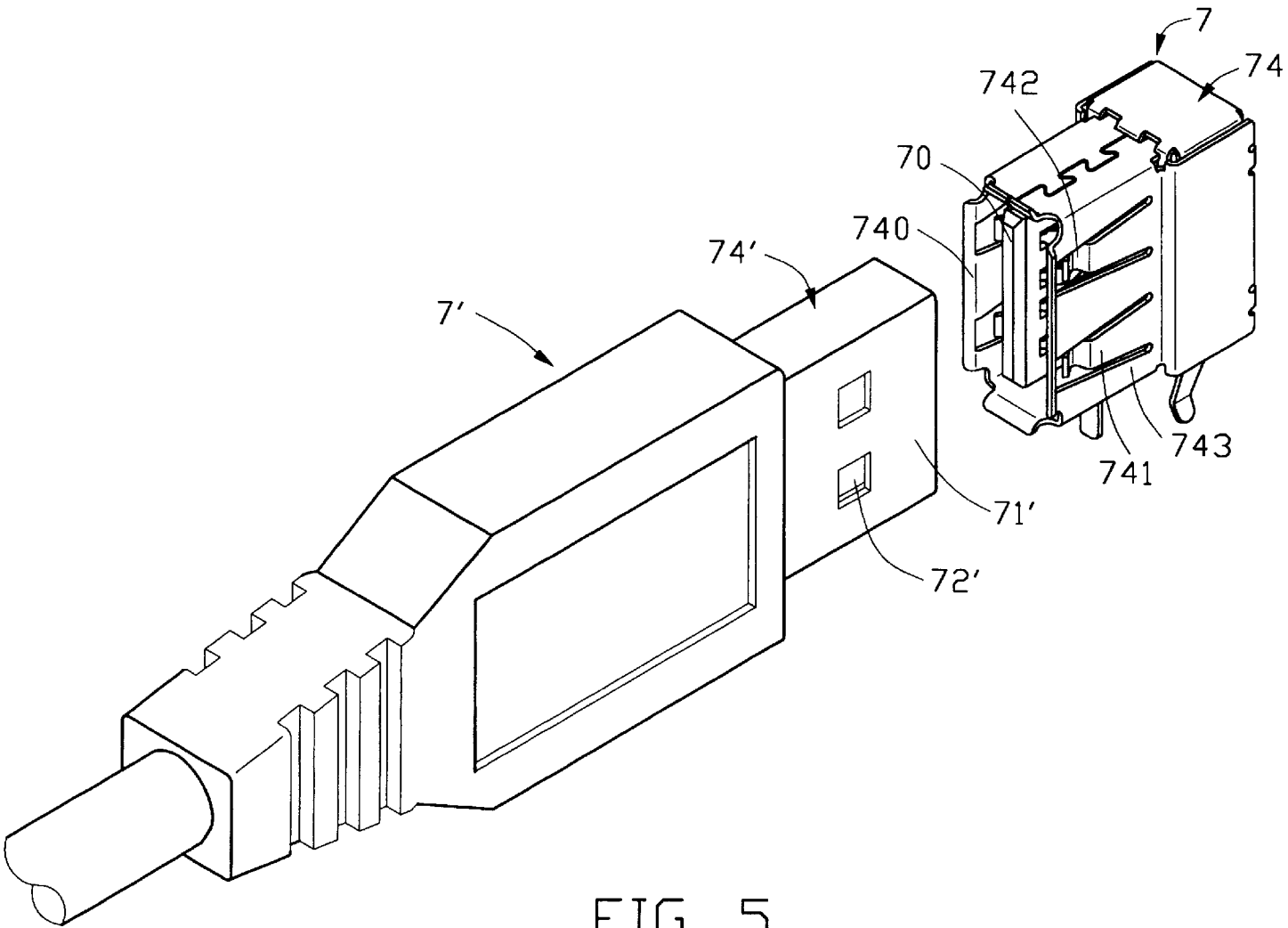
FIG. 5 (PRIOR ART)
FIG. 5 is an exploded perspective view of the conventional USB receptacle connector.
Figure 6:
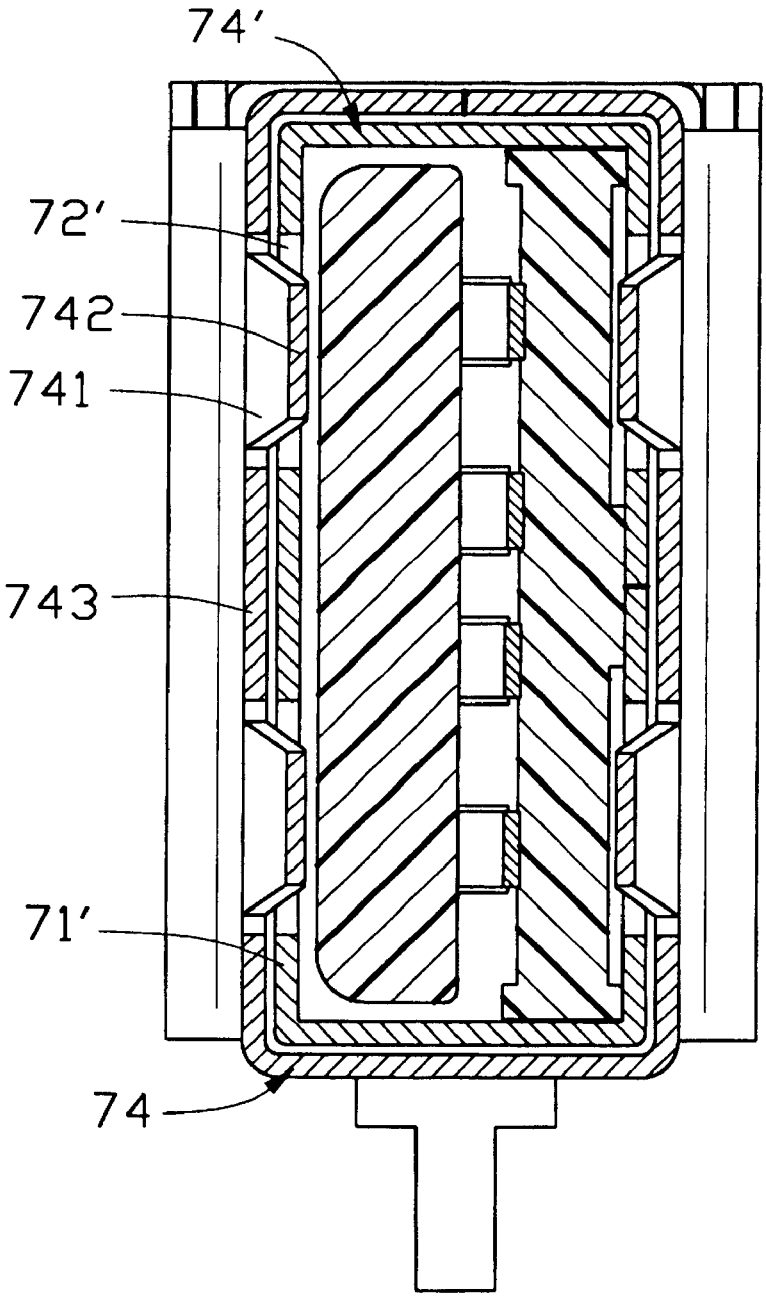
FIG. 6 (PRIOR ART)
FIG. 6 is a sectional view of the conventional USB receptacle connector which has connected with the conventional mating plug connector but the two shells do not contact with each other.

Referring to FIG. 2 and FIG. 3, when the USB receptacle connector 1 connects with the mating plug connector 1', the engaging heads 114 of the front shell part 11 slide into rectangular holes 12' of two side faces 112' of a shell 11' of the mating plug connector 1' and are received in the rectangular holes 12'. After the shell 11 of the USB receptacle connector 1 connects with the shell 11' of the mating plug connector 1', the two shells 11 and 11' can be grounded and present zero voltage. Also, the contact portions 116 of the contact tabs 115 of the front shell part 11 can contact the two side faces 112' of the shell 11' all the time during the mating/unmating of the two connectors 1 and 1'. When the engaging heads 114 of the latches 113 of the front shell part 11 do not always contact with the two side faces 112' of the shell 11' and have interval interruption, the two shells 11 and 11' are still continuously grounded so as to ensure the continuous grounding and EMI shielding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A USB receptacle connector for connecting with a mating plug connector, comprising:

an insulative housing comprising a plurality of receiving passageways;

a plurality of terminals received in the receiving passageways of the insulative housing; and a metal shell covering the insulative housing and comprising a mating port for insertion of the mating plug connector, the mating port having two sidewalls each of said sidewalls defining a pair of latches extending forward and a contact tab extending from the mating port rearward and between the two latches for making the shell constantly contact with a shell of the mating plug connector; wherein the shell comprises a front shell part and a rear shell part, the mating port is formed in a front end of the front shell part, and each of said contact tabs is defined at a side of the mating port; wherein the front shell part has a bottom face forming a board lock for mounting the USB receptacle connector onto a printed circuit board.

* * * * *